US009409374B2

(12) United States Patent
Ohira et al.

(10) Patent No.: US 9,409,374 B2
(45) Date of Patent: Aug. 9, 2016

(54) DOUBLE FACER, AND METHOD AND DEVICE FOR GLUING THEREOF

(75) Inventors: Kazuhito Ohira, Mihara (JP); Kazuki Mizushima, Mihara (JP)

(73) Assignee: MITSUBISHI HEAVY INDUSTRIES PRINTING & PACKAGING MACHINERY, LTD., Mihara-Shi, Hiroshima (JP)

( * ) Notice: Subject to any disclaimer, the term of this patent is extended or adjusted under 35 U.S.C. 154(b) by 678 days.

(21) Appl. No.: 13/578,162

(22) PCT Filed: Mar. 23, 2011

(86) PCT No.: PCT/JP2011/056869

§ 371 (c)(1),
(2), (4) Date: Aug. 9, 2012

(87) PCT Pub. No.: WO2011/125487

PCT Pub. Date: Oct. 13, 2011

(65) Prior Publication Data

US 2013/0017941 A1 Jan. 17, 2013

(30) Foreign Application Priority Data

Apr. 7, 2010 (JP) ..... 2010-088933

(51) Int. Cl.
*B05C 1/00* (2006.01)
*B31F 1/28* (2006.01)

(52) U.S. Cl.
CPC ..... *B31F 1/2818* (2013.01)

(58) Field of Classification Search
CPC ..... B05D 5/00; B29C 66/22; B29C 66/223; B21B 37/00; B31F 1/2818; B31F 1/2813
USPC ..... 156/494, 470; 493/336
See application file for complete search history.

(56) References Cited

U.S. PATENT DOCUMENTS 2,827,873 A 3/1958 Thorn
3,520,276 A * 7/1970 Martin Louis ..... B31F 1/2818 118/262

(Continued)

FOREIGN PATENT DOCUMENTS

DE 20000178 U1 5/2000
JP H05-18828 U 3/1993

(Continued)

OTHER PUBLICATIONS

Japan Patent Office, "Decision to Grant a Patent for JP2010-088933," Dec. 17, 2013.

(Continued)

*Primary Examiner* — Robert Long
*Assistant Examiner* — Xavier A Madison
(74) *Attorney, Agent, or Firm* — Manabu Kanesaka; Benjamin Hauptman; Kenneth Berner

(57) ABSTRACT

A device for gluing of a double facer includes a glue bath containing glue; a gluing roll immersed in and coated with the glue; a doctor roll adjusting the glue on the gluing roll to a predetermined thickness, transferred to a single faced corrugated cardboard; a swing roll disposed at an upstream portion of a transferring direction of the corrugated cardboard; and a moving device that moves the swing roll in a direction that the single faced corrugated cardboard is wrapped around the gluing roll. The swing roll is wrapped around the single faced corrugated cardboard, and the number of flute tips of the single faced corrugated cardboard that are concurrently contacting with the gluing roll and applied with the glue is adjusted by moving only the swing roll in such a direction that crosses a sheet face of the single faced corrugated cardboard passing through the nip.

18 Claims, 3 Drawing Sheets

(56) References Cited

U.S. PATENT DOCUMENTS

| | | | | |
|---|---|---|---|---|
| 6,602,546 | B1 | 8/2003 | Kohler | |
| 2005/0194103 | A1 | 9/2005 | Kohler | |
| 2007/0098887 | A1 * | 5/2007 | Kohler | 427/207.1 |

FOREIGN PATENT DOCUMENTS

| | | | |
|---|---|---|---|
| JP | H08-267620 | A | 10/1996 |
| JP | 2004-42638 | A | 2/2004 |
| JP | 2007-526122 | A | 9/2007 |

OTHER PUBLICATIONS

PCT, "English translation of the International Preliminary Report on Patentability for PCT/JP2011/056859", Nov. 6, 2012.

Europe Patent Office, "Search Report for EP 11765388.1," Nov. 10, 2015.

* cited by examiner

| Optimum number of flutes being concurrently in contact | Small | large |
|---|---|---|
| Basic weight (paper type) | light-weight paper | heavy- weight paper |
| Flute shape (flute type) | small | large |
| Travelling speed | low speed | high speed |

DOUBLE FACER, AND METHOD AND DEVICE FOR GLUING THEREOF

RELATED APPLICATIONS

The present application is National Phase of International Application No. PCT/JP2011/056869 filed Mar. 23, 2011, and claims priority from, Japanese Application No. 2010-088933, filed Apr. 7, 2010, the disclosure of which is hereby incorporated by reference herein in its entirety.

TECHNICAL FIELD

The present invention relates to a method of and a device for gluing flute tips of a single faced corrugated cardboard travelling in a double facer incorporated in a corrugator that manufactures corrugated cardboards, and also relates to a double facer including the above gluing device.

BACKGROUND

A double facer incorporated in a corrugator uses a gluing device that applies glue to the flute tips of a single faced corrugated cardboard, which is formed by gluing a medium web with a bottom linerboard, so that the single faced corrugated cardboard is glued with a top linerboard.

The gluing device deposits glue stored in a glue bath onto a gluing roll and adjusts the glue on the gluing roll to a predetermined thickness using a doctor roll. After that, the device passes a single faced corrugated cardboard through a nip between the gluing roll and a pressure roll, and transfers the glue on the gluing roll to the flute tips of the single faced corrugated cardboard while passing through the nip.

Normally, an amount of glue to be applied to a single faced corrugated cardboard is adjusted by the space between the gluing roll and the doctor roll. Alternatively, the amount of glue to be applied can be adjusted by adjusting the number of flute tips being concurrently in contact with the gluing roll. Specifically, more flutes being concurrently in contact increases an amount of glue to be applied to each flute tip. The number of flutes being in contact with the gluing roll at the same time is practically three or so.

If an excessive amount of glue is applied to flute tips of a single faced corrugated cardboard, the portion applied excessive glue to excessively shrinks after the applied glue is dried and the flatness of the resultant single faced corrugated cardboard is not maintained. An optimum amount of glue to be applied to each flute tip is different with the basic weight of the paper web or the flute shape (flute type) of a single faced corrugated cardboard as well as the traveling speed of the single faced corrugated cardboard.

Patent Literature 1 discloses means for changing the number of flutes being concurrently in contact with the gluing roll, so that an optimum amount of glue can be applied in accordance with the traveling speed of the single faced corrugated cardboard. Hereinafter, description will now be made in relation to a method of gluing disclosed in Patent Literature 1 with reference to FIG. 4(*a*) and FIG. 4(*b*).

A gluing device 100 of the double facer in FIG. 4(*a*) and FIG. 4(*b*) includes a glue bath 102 containing glue g; a gluing roll 104 having a lower part immersed in the glue g; a doctor roll 106 disposed above the surface of the glue g; and a pressure roll 108 forming a nip N between the gluing roll 104 and the pressure roll 108.

A single faced corrugated cardboard k manufactured in a single facer that is disposed upstream of the double facer is heated by a non-illustrated preheater, then travels in the direction of the arrow a to be wrapped around the pressure roll 108, and enters the nip N between the gluing roll 104 and the pressure roll 108. Flute tips m of the single faced corrugated cardboard k wrapped around the pressure roll 108 are applied with glue g adhering to the surface of the gluing roll 104.

In FIG. 4(*a*), if a casing 110 that supports the gluing roll 104 and the doctor roll 106 is moved in the direction of arrow b using a non-illustrated driving device, two or more (e.g., four) flute tips m of the single faced corrugated cardboard k come into contact with the gluing roll 104. This makes it possible to surely apply glue g to the flute tips of the single faced corrugated cardboard k even the double facer is running at a high speed.

In FIG. 4(*b*), if the casing 110 is moved in the direction of arrow c while the single faced corrugated cardboard k travels at a relatively low speed, only one flute tip of the single faced corrugated cardboard k, for example, comes into contact with the gluing roll 104, so that, according to Patent Literature 1, an excessive amount of glue g is not applied even during low-speed operation.

Furthermore, Patent Literature 1 states that: since the single faced corrugated cardboard k which is leaned to be flat in the width direction is wrapped around the pressure roll 108, the single faced corrugated cardboard k can be free from warp and can be applied glue film uniformly in the width direction. Also, Patent Literature 1 states that the pressure roll 108 may be moved forwards or backwards in the directions of arrows b and c in place of the gluing roll 104.

PRIOR ART REFERENCE

Patent Literature

[Patent Literature 1] Japanese Laid-Open Patent Publication No. HEI 8-267620

SUMMARY

Problems to be Solved by Invention

The gluing device 100 disclosed in Patent Literature 1 makes it possible to change the number of flutes of the single faced corrugated cardboard k, the flutes being concurrently in contact with the gluing roll 104, by the movable configuration of the gluing roll 104 or the pressure roll 108. However, this manner impels the relative position between the gluing roll 104 and the pressure roll 108 to change each time the operation condition changes. The space between the pressure roll and the gluing roll requires precise setting, which needs frequent readjustment of the space between the rolls and burdens much complex labor.

In addition, since the pressure roll 108 is arranged over the gluing roll 104, the space between the central parts of the rolls becomes narrower when the central part of the pressure roll 108 bends under the weight of the pressure roll 108 itself, which causes a problem of the space of the nip between the gluing roll 104 and the pressure roll 108 being not uniform in the axis direction. In particular, when the single faced corrugated cardboard k has the number of flutes being concurrently in contact being one, there is a high possibility that only the center position of the single faced corrugated cardboard k comes into contact with the gluing roll 104 or is squeezed.

Furthermore, as shown in FIG. 4(*a*), when the single faced corrugated cardboard k is leaving the gluing roll 104, a splash s of glue scattering in the tangent direction of the gluing roll 104 occurs around the exit of the gluing device. The splash s soils the portion around the exit with glue and consequently requires frequent cleaning.

In addition, as shown in FIG. 4(*b*), since the single faced corrugated cardboard k travels in the tangent direction of the gluing roll 104, the leaving position d is not constant at which the flute tips of the single faced corrugated cardboard k leaves the surface of the gluing roll 104. This causes a problem that glue is not constantly applied to flute tips.

With the foregoing problems in view, a first object of the present invention is to change an amount of glue to be applied to a single faced corrugated board in a wide range, so that an amount of glue to be applied to a single faced corrugated cardboard can be easily adjusted.

A second object of the present invention is to apply glue in a wide range of amount evenly in the width direction of the single faced corrugated cardboard. In particular, the object is aiming at, even when the number of flutes concurrently in contact is one, evenly applying glue, so that the amount of glue can be saved.

A third object of the present invention is to avoid soiling due to a splash of glue that occurs at a position where the flute tips of a single faced corrugated cardboard leave the surface of the gluing roll in the tangent direction of the gluing roll, and concurrently to achieve constant glue application to the flute tips at the position.

A fourth object of the present invention is to enable an amount of glue to be applied to be adjusted automatically according to change in paper type of a single faced corrugated cardboard or change in operation condition even during the operation of the corrugator.

Means to Solve Problem

To attain the objects, there is provided a method for gluing a single faced corrugated cardboard in a double facer, the method including: immersing part of a gluing roll in glue contained in a glue bath; adjusting glue adhering to the gluing roll to a predetermined film thickness by a doctor roll; and transferring the glue to flute tips of the single faced corrugated cardboard while the single faced corrugated cardboard is passing through a nip between the gluing roll and a pressure roll, wherein the single faced corrugated cardboard is wrapped around a swing roll disposed at an upstream portion of a transferring direction of the single faced corrugated cardboard from the nip between the gluing roll and the pressure roll, and the number of flute tips of the single faced corrugated cardboard that are to be concurrently in contact with the surface of the gluing roll and applied the glue is adjusted by moving the swing roll in such a direction that the single faced corrugated cardboard is wrapped around the gluing roll when the single faced corrugated cardboard is passing through the nip.

In this method, the number of flute tips of the single faced corrugated cardboard that are to be concurrently in contact with the surface of the gluing roll can be easily changed by moving the swing roll in such a direction that the single faced corrugated cardboard is wrapped around the gluing roll while the cardboard passes through the nip between the gluing roll and the pressure roll (that is, in a direction that crosses the sheet face of the single faced corrugated cardboard passing through the nip). This configuration makes it possible to easily adjust an amount of glue to be applied to each flute tip of the single faced corrugated cardboard.

Further, since this configuration moves only the swing roll, the relative position between the gluing roll and the pressure roll is unchanged.

In this method, the center axes of the gluing roll and the pressure roll may be horizontally arranged, and the pressure roll may be horizontally arranged for the gluing roll, so that a bend caused by the weight of the pressure roll is not generated (does not influence) on the nip between the gluing roll and the pressure roll.

This configuration makes it possible to keep the space of the nip between the gluing roll and the pressure roll uniform in the axis direction (i.e., cross direction), so that, even when the number of flutes being concurrently in contact is one, the glue can be surely applied to the flue tips of a single faced corrugated board and the amount of glue can also be saved.

Additionally, the swing roll may be arranged over/above the gluing roll and the pressure roll; the single faced corrugated cardboard may enter the nip between the gluing roll and the pressure roll from the upper to the nip; and the single faced corrugated cardboard may be wrapped around the surface of the pressure roll at the exit of the nip and may be transferred in the lateral direction, so that a space under the nip is empty.

This configuration downwardly directs a splash of glue scattering in the tangent direction of the gluing roll when the single faced corrugated cardboard is leaving the gluing roll. Since the glue bath is disposed under the gluing roll, the splash can be returned to the glue bath, eliminating the possibility of soiling an area around the exit of the gluing roll with scattering glue.

In addition, since the single faced corrugated cardboard is wrapped around the surface of the pressure roll and is thereby forwarded in the lateral direction at the exit of the nip between the gluing roll and the pressure roll, the single faced corrugated cardboard sharply leaves the gluing roll, so that the flute tips of the single faced corrugated cardboard come of f the gluing roll at a constant point. Consequently, the flute tips can be glued constantly.

Furthermore, in the method of the present invention, the number of flute tips of the single faced corrugated cardboard that are to be concurrently in contact with the surface of the gluing roll and applied the glue may be adjusted by moving the swing roll in accordance with at least one of parameters of a basic weight (paper type), a flute shape (flute type), and a travelling speed. An optimum amount of glue to be applied to each flute tip is determined by at least one of the above parameters. Such an adjustment that changes an amount of glue to be applied on the basis of the parameter makes it possible to apply an optimum amount of glue according to change in paper type of a single faced corrugated cardboard and/or in operation condition.

There is provided a gluing apparatus of the double facer that can be directly applied to the method of the present invention includes: a glue bath that contains glue; a gluing roll that is partially immersed in the glue and that is coated with the glue; a doctor roll that adjusts the glue on the gluing roll to a predetermined thickness, the glue adjusted to the predetermined thickness on the gluing roll being transferred to a single faced corrugated cardboard; a swing roll that is disposed at an upstream portion of a transferring direction of the single faced corrugated cardboard from a nip between the gluing roll and a pressure roll; and a moving device that moves the swing roll in such a direction that the single faced corrugated cardboard is wrapped around the gluing roll when the single faced corrugated cardboard is passing through the nip, wherein the single faced corrugated cardboard is wrapped around the swing roll and the number of flute tips of the single faced corrugated cardboard that are to be concurrently in contact with the surface of the gluing roll and applied the glue is adjusted by moving the swing roll in such a direction that the single faced corrugated cardboard is wrapped around the gluing roll when the single faced corrugated cardboard is passing through the nip.

In the device of the present invention, the number of flute tips of the single faced corrugated cardboard that are to be concurrently in contact with the surface of the gluing roll can be easily changed by moving the swing roll in such a direction that the single faced corrugated cardboard is wrapped around the gluing roll so that an amount of glue to be applied to each flute tip of the single faced corrugated cardboard can be easily adjusted. At that time, the relative position between the gluing roll and the pressure roll is unchanged.

Additionally in the device of the present invention, the center axes of the gluing roll and the pressure roll may be horizontally arranged, and the pressure roll may be arranged on the same horizontal level as the gluing roll, so that a bend caused by the weight of the pressure roll is not generated (does not influence) on the nip between the gluing roll and pressure roll. Preferably, the gluing roll and the pressure roll may be arranged such that an angle between a plane connecting the center axis of the gluing roll with the center axis of the pressure roll and a horizontal plane is within ±15 degrees.

This configuration makes it possible to keep the space between the gluing roll and the pressure roll uniform in the axis direction (i.e., cross direction), so that, even when the number of flutes being concurrently in contact is one, the glue can be surely applied to the flue tips of a single faced corrugated board, and the amount of glue can also be saved.

Furthermore, in the device of the present invention, the swing roll may be arranged over/above the gluing roll and the pressure roll; the single faced corrugated cardboard may enter the nip between the gluing roll and the pressure roll from the upper end of the nip; and the single faced corrugated cardboard may be wrapped around the surface of the pressure roll at the exit of the nip to be transferred in the lateral direction, so that a space under the nip is empty.

This configuration downwardly directs a splash of glue scattering in the tangent direction of the gluing roll when the single faced corrugated cardboard is leaving the gluing roll. Since the glue bath is disposed under the gluing roll, the splash can be returned to the glue bath, eliminating the possibility of soiling an area around the exit of the gluing roll with scattering glue.

In addition, since the single faced corrugated cardboard is wrapped around the surface of the pressure roll and is thereby forwarded in the lateral direction at the exit of the nip between the gluing roll and the pressure roll, the single faced corrugated cardboard sharply leaves the gluing roll, so that the flute tips of the single faced corrugated cardboard come off the gluing roll at a constant point. Consequently, the flute tips can be glued constantly.

The device of the present invention may further includes a controller that adjusts the number of flute tips of the single faced corrugated cardboard that are to be concurrently in contact with the surface of the gluing roll and applied the glue by moving the swing roll in accordance with at least one of parameters of a basic weight (paper type), a flute shape (flute type), and a travelling speed.

The controller adjusts an amount of glue to be applied to the flute tips of the single faced corrugated cardboard on the basis of the above parameters. Such an adjustment that changes an amount of glue to be applied on the basis of the parameters makes it possible to apply an optimum amount of glue according to change in paper type of a single faced corrugated cardboard and/or in operation condition. In addition, the amount of glue to be applied can be automatically controlled. Specifically, the amount of glue to be applied can be automatically controlled even during the operation of the corrugator.

The controller can be incorporated in a production management device that manages the entire operation of a corrugator that manufactures corrugated cardboards.

The double facer of the present invention includes the gluing device having the above configuration. The gluing device makes the double facer possible to easily adjust an amount of glue to be applied to each flute tip of a single faced corrugated cardboard.

Effects of Invention

The method of the present invention includes: immersing part of a gluing roll into glue contained in a glue bath; adjusting glue adhering to the gluing roll to a predetermined thickness by a doctor roll; and transferring the glue to flute tips of the single faced corrugated cardboard while the single faced corrugated cardboard is passing through a nip between the gluing roll and a pressure roll, wherein the single faced corrugated cardboard is wrapped around a swing roll disposed at an upstream portion of a transferring direction of the single faced corrugated cardboard from the nip between the gluing roll and the pressure roll, and the number of flute tips of the single faced corrugated cardboard that are to be concurrently in contact with the surface of the gluing roll and applied the glue is adjusted by moving the swing roll in such a direction that the single faced corrugated cardboard which is passing through the nip is wrapped around the gluing roll. This configuration makes it possible to easily adjust an amount of glue to be applied to each flute tip of the single faced corrugated cardboard, and does not change the relative position between the gluing roll and the pressure roll. Therefore, the flute tips of the single faced corrugated cardboard leave the surface of the gluing roll at a constant point, so that a constant amount of glue can be applied to each flute tip.

The gluing device for a double facer of the present invention includes: a glue bath that contains glue; a gluing roll that is partially immersed in the glue and that is coated with the glue; a doctor roll that adjusts the glue on the gluing roll to a predetermined thickness, the glue adjusted to the predetermined thickness on the gluing roll being transferred to a single faced corrugated cardboard; a swing roll that is disposed at an upstream portion of a transferring direction of the single faced corrugated cardboard from a nip between the gluing roll and a pressure roll; and a moving device that moves the swing roll in such a direction that the single faced corrugated cardboard which is passing through the nip is wrapped around the gluing roll, wherein the single faced corrugated cardboard is wrapped around the swing roll, and the number of flute tips of the single faced corrugated cardboard that are to be concurrently in contact with the surface of the gluing roll and applied the glue is adjusted by moving the swing roll in such a direction that the single faced corrugated cardboard which is passing through the nip is wrapped around the gluing roll. The configuration of the gluing device ensures the same effects at those of the above method.

The double facer of the present invention includes the gluing device having the above configuration, and can ensure the same effects as those of the above method.

DESCRIPTION OF EMBODIMENTS

Hereinafter, the present invention will now be detailed with reference to the accompanying drawings illustrating various embodiments. However, dimension, material, shape, and relative position of the components described in embodiments should by no means be limited to those of the descriptions unless specified.

First Embodiment

Figure 1:
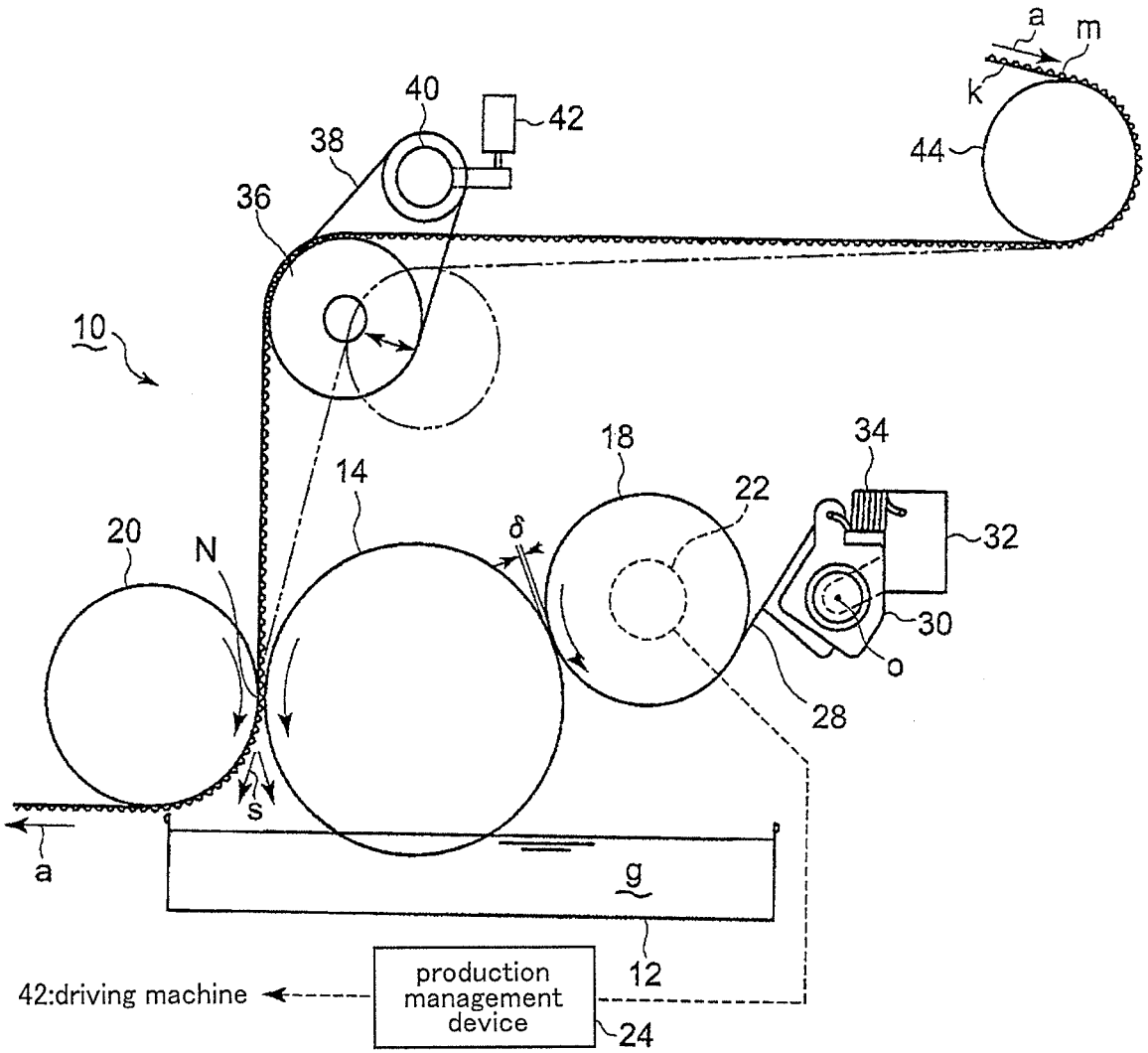
FIG. 1 A diagram illustrating the configuration of a gluing device of a double facer according to a first embodiment of a method and a device of the present invention.

The method and the device of a first embodiment of the present invention will now be detailed with reference to FIG. 1. In a gluing device 10 of the first embodiment of FIG. 1, glue g made of starch glue is stored in a glue bath 12 and part of a gluing roll 14 is immersed in the glue g.

The gluing roll 14 is disposed so as to face a doctor roll 18 and a pressure roll 20. The axes of these three rolls are disposed parallel to each other, and rotate in the directions of the respective arrows. The doctor roll 18 regulates the thickness of a glue film adhering to the gluing roll 14 to a predetermined thickness. A single faced corrugated cardboard k is downwards fed into a nip N formed between the gluing roll 14 and the pressure roll 20. The glue g is applied to the flute tips m of the single faced corrugated cardboard k passing through the nip N.

A space δ is formed between the gluing roll 14 and the doctor roll 18. A uniform glue film having a thickness δ is formed on the outer surface of the gluing roll 14 by the glue g passing through the space δ. The glue g in amount corresponding to the film thickness δ is applied to each flute tip m of the single faced corrugated cardboard k. The doctor roll 18 is configured to move close to or apart from the gluing roll 14 by an eccentric cam mechanism 22. The eccentric cam mechanism 22 adjusts the space δ.

A production management device 24 is provided, which manages the entire operation of the corrugator. The production management device 24 controls the eccentric cam mechanism 22 such that the space δ is adjusted, and also controls a driving machine 42 of the swing roll 36, which will be detailed below.

A doctor blade 28 is disposed so as to face the doctor roll 18. The doctor blade 28 scrapes glue adhered at the nip between the gluing roll 14 and the doctor roll 18 off the surface of the doctor roll 18, so that the remaining glue is avoided from being fed into the nip again. The doctor blade 28 is fixed to a mount 30, which is mounted on a supporting frame 32 so as to be rotatable around the center O. A coil spring 34 is hung between the mount 30 and the supporting frame 32. The coil spring 34 presses the doctor blade 28 against the outer surface of the doctor roll 18 by predetermined resilience force.

The swing roll 36 is disposed over the gluing roll 14 and is supported by an axis 40 via an arm 38. Furthermore, a driving machine 42 is disposed, which rotates the axis 40. The swing roll 36 is movable, by the driving machine 42, in the direction (of the arrow) substantially orthogonal to the sheet face of a single faced corrugated cardboard passing through the nip N between the gluing roll 14 and the pressure roll 20. A guide roll 44 is disposed at the right hand of the axis 40. The axis 40 and the guide roll 44 are rotatably supported and fixed by a non-illustrated supporting frame.

With this configuration, the glue g is applied to the outer surface of the gluing roll 14. The glue film formed on the gluing roll 14 is adjusted to have a predetermined thickness corresponding to the space δ while passing through the doctor roll 18 and is then applied to the flute tips m of a single faced corrugated cardboard k at the nip N between the gluing roll 14 and the pressure roll 20.

The production management device 24 sends an instruction signal to the driving machine 42 of the axis 40 so that the position of the swing roll 36 is determined along the direction orthogonal to the sheet face of a single faced corrugated cardboard k passing the nip N. Thereby, the number of flute tips m being concurrently in contact with the gluing roll 14 can be adjusted such that the amount of glue to be applied to each flute tip m is optimized. A single faced corrugated cardboard k having flute tips m glued when passing through the nip N is wrapped around the pressure roll 20 at the exit of the nip N and then transferred in the horizontal direction.

In the first embodiment, the number of flute tips m being concurrently in contact with the surface of the gluing roll can be easily changed by moving the swing roll 36 in the direction substantially orthogonal to the sheet face of a single faced corrugated cardboard k passing through the nip N between the gluing roll 14 and the pressure roll 20. This makes it possible to easily adjust an amount of glue to be applied to each flute tip m of a single faced corrugated cardboard k.

In this case, only the swing roll 36 moves and the relative positions of the gluing roll 14 and the pressure roll 20 are fixed, so that the flute tips m of a single faced corrugated cardboard k are removed from the surface of the gluing roll 14 at the constant point at the downstream portion of the nip N. Consequently, a constant amount of glue can be applied to each flute tip.

The center axes of the gluing roll 14 and the pressure roll 20 are arranged in the horizontal direction and also the pressure roll 20 is also horizontally arranged relatively to the gluing roll 14, so that a bend caused by the weight by the pressure roll 20 is not generated on the nip N. Since this configuration can keep the space in the axis direction between the gluing roll 14 and the pressure roll 20 to be uniform, glue can be surely applied to the flute tips m of a single faced corrugated cardboard k even if the number of flutes m being concurrently in contact is one. This can further save the amount of glue.

The experiments conducted by Inventors revealed that, if the angle between a face connecting the center of rotation of the gluing roll 14 and that of the pressure roll 20 and the horizontal face is within ±15 degrees, the space between the gluing roll 14 and the pressure roll 20 can be kept constant and a bend caused by the weight of the pressure roll 20 has a less influence. In contrast, if the angle exceeds ±15 degrees, the bend caused by the weight of the pressure roll 20 comes to affect a glue film and thereby makes the glue film to have an uneven thickness in the roll axis direction.

The single faced corrugated cardboard k is wrapped around the surface of the pressure roll 20 at the exit of the nip N and then transferred in the lateral direction, so that the space under the nip N is empty. A splash s of glue scattering in the tangent direction of the gluing roll 14 when the single faced corrugated cardboard k leaves the gluing roll 14 can be directed downwards. Thereby, the splash s can be returned to the glue bath 12 disposed under the gluing roll 14. It is possible to prevent glue from scattering everywhere and the gluing device can be avoided from being smeared with scattered glue.

Since the single faced corrugated cardboard k is wrapped around the surface of the pressure roll 20 at the exit of the nip N and then transferred in the lateral direction, the single faced corrugated cardboard k rapidly comes off the gluing roll 14. Thereby, the flute tips m of the single faced corrugated cardboard k can leave the gluing roll 14 at a constant point, so that the flute tips m can be evenly glued.

Second Embodiment

Figures 2, 3:
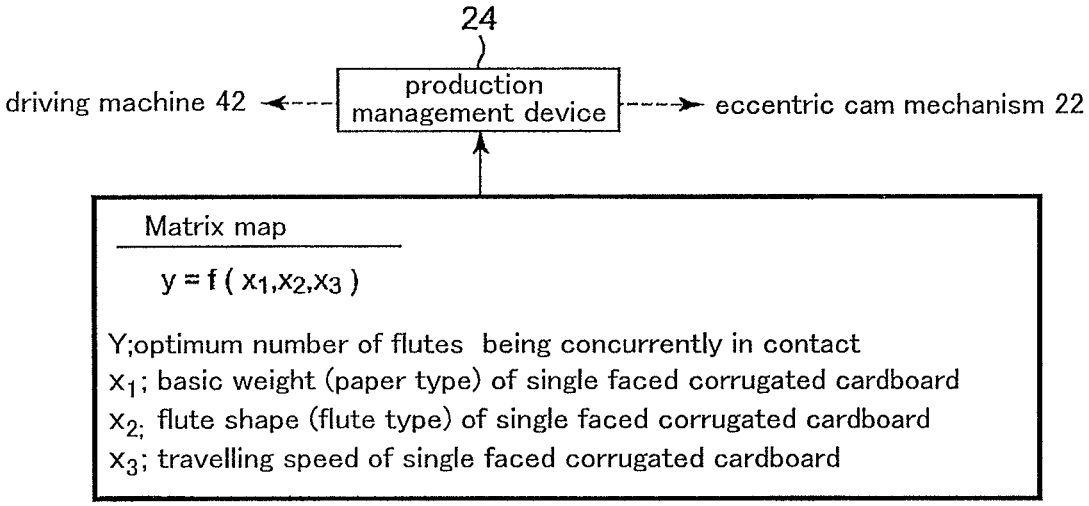
FIG. 2 A diagram illustrating the configuration of a production management device according to a second embodiment of a method and a device of the present invention.
FIG. 3 A table indicating an example of characteristics of parameters that determine the optimum number of flutes being concurrently in contact in the second embodiment.
Figure 4A:
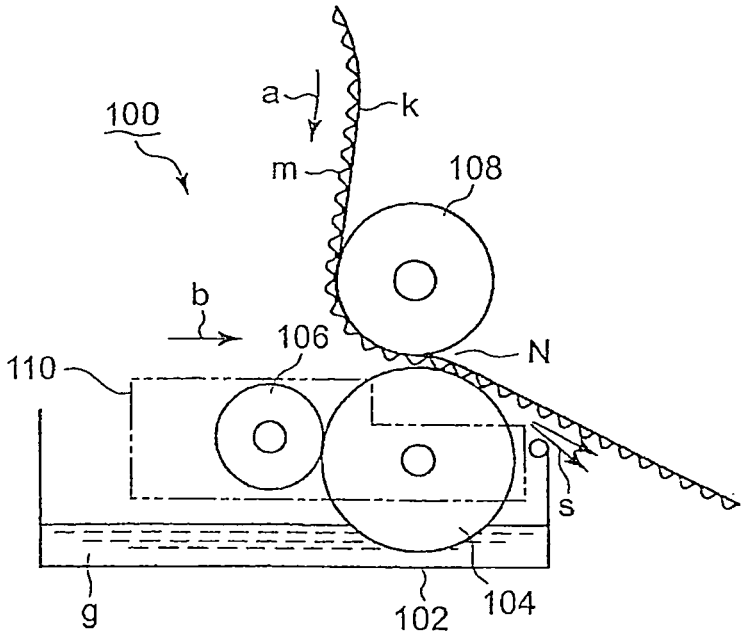
FIG. 4(a) Prior Art
FIG. 4(*a*) and FIG. 4(*b*) Diagrams illustrating the configuration of a conventional gluing device of a double facer.
Figure 4B:
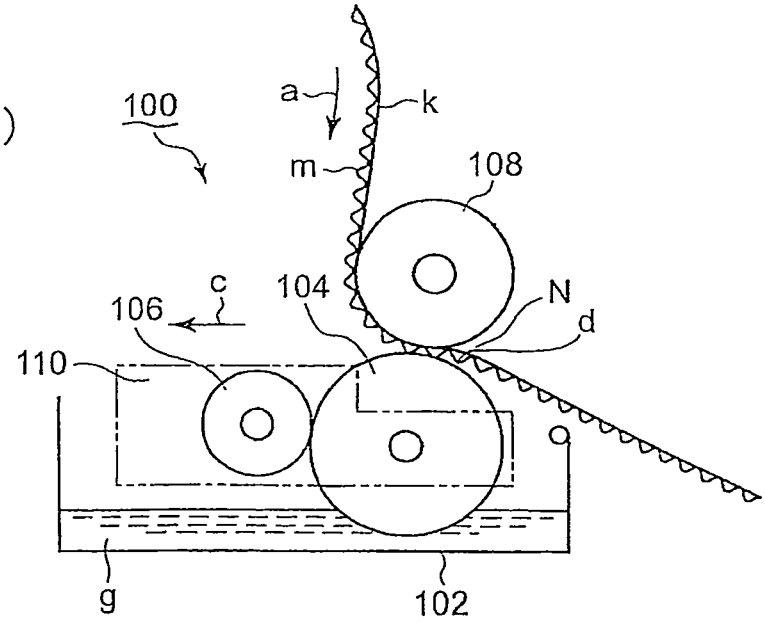
FIG. 4(b) Prior Art

Next, description will now be made in relation to the method and the device according to a second embodiment of the present invention with reference to FIGS. 2 and 3. A gluing device of the second embodiment has the same hardware configuration as that of the first embodiment. The number of flutes being concurrently in contact, which is set for applying an optimum amount of glue to each flute tip m of the single faced corrugated cardboard k, depends on parameters of basic weight (paper type), flute shape (flute type), and travelling speed. FIG. 3 is a table indicating an example of qualitative relationship between characteristics of parameters and the optimum number of flutes being concurrently in contact.

For example, if the paper web forming the single faced corrugated cardboard k is light-weight paper having a light basic weight or a flute type having small flutes, the number of flutes being concurrently in contact is small while the paper web is heavy-weight paper having a heavy basic weight or has large flutes, the number of flutes being concurrently in contact is large. This means that the paper web being heavy-weight paper or a flute type having large flutes requires the number of flutes being concurrently in contact to be large so that an amount of glue to be applied to each flute tip is ensured.

If the single faced corrugated cardboard k travels slowly, the number of flutes being concurrently in contact is small while, if the cardboard k travels quickly, the number of flutes being concurrently in contact is large. This means that the single faced corrugated cardboard k travelling slowly requires the number of flutes being concurrently in contact to be small so that excessive glue is not applied to each flute tip.

For the above, the second embodiment previously calculates the optimum number y of flutes being concurrently in contact associated with a number of parameters ($x_1$ through $x_3$) through experiments, and obtains a matrix map based on the experimental values. Then, the matrix map is stored in the production management device 24. This makes it possible to automatically select the optimum number of flutes being concurrently in contact in accordance with the basic weight (paper type) of the single faced corrugated cardboard and operation condition through operating by driving machine 42 from the production management device 24. Also, this makes it possible to automatically change the number of flutes being concurrently in contact even when the corrugated cardboard manufacturing device is operating.

The second embodiment obtains the optimum number of flutes being concurrently in contact from the three parameters. Alternatively, the present invention may determine the optimum number of flutes being concurrently in contact from at least one of these parameters.

INDUSTRIAL APPLICABILITY

The present invention enables the gluing device of a double facer to optimize an amount of glue to be applied to each flute tip of a single faced corrugated cardboard and also to evenly apply glue to a single faced corrugated cardboard in the width direction. This configuration can apply glue to a flute tip even when the number of flutes being concurrently in contact is one, and consequently glue can be saved.

The invention claimed is:

1. A method for gluing a single faced corrugated cardboard in a double facer, the method comprising:

immersing part of a gluing roll into glue contained in a glue bath;

adjusting the glue adhering to the gluing roll to a predetermined thickness by a doctor roll; and transferring the glue to flute tips of the single faced corrugated cardboard while the single faced corrugated cardboard is passing through a nip between the gluing roll and a pressure roll, wherein the single faced corrugated cardboard is wrapped around a swing roll disposed at an upstream portion of a transferring direction of the single faced corrugated cardboard from the nip between the gluing roll and the pressure roll, a number of flute tips of the single faced corrugated cardboard that are to be concurrently in contact with the gluing roll and applied with the glue is adjusted by moving only the swing roll in such a direction that crosses a sheet face of the single faced corrugated cardboard passing through the nip, center axes of the gluing roll and the pressure roll are horizontally arranged, and the pressure roll is arranged on the same horizontal level as the gluing roll, so that a bend caused by the weight of the pressure roll is not generated on the nip between the gluing roll and pressure roll.

2. The method according to claim 1, wherein:

the swing roll is arranged above the gluing roll and the pressure roll;

the single faced corrugated cardboard enters the nip between the gluing roll and the pressure roll from the upper end of the nip; and the single faced corrugated cardboard is wrapped around the pressure roll at an exit of the nip and is transferred in the lateral direction, so that a space under the nip is empty.

3. The method according to claim 1, wherein the number of flute tips of the single faced corrugated cardboard that are to be concurrently in contact with the gluing roll and applied with the glue is adjusted by moving the swing roll in accordance with one of parameters of a basic weight, a flute shape, and a travelling speed.

4. The method according to claim 2, wherein the number of flute tips of the single faced corrugated cardboard that are to be concurrently in contact with the gluing roll and applied with the glue is adjusted by moving the swing roll in accordance with one of parameters of a basic weight, a flute shape, and a travelling speed.

5. A device for gluing of a double facer, the device comprising:

a glue bath that contains glue;

a gluing roll that is partially immersed in the glue and that is coated with the glue;

a doctor roll that adjusts the glue on the gluing roll to a predetermined thickness, the glue adjusted to the predetermined thickness on the gluing roll being transferred to a single faced corrugated cardboard;

a swing roll that is disposed at an upstream portion of a transferring direction of the single faced corrugated cardboard from a nip between the gluing roll and a pressure roll; and a moving device that moves the swing roll in such a direction that the single faced corrugated cardboard is wrapped around the gluing roll when the single faced corrugated cardboard is passing through the nip, wherein the single faced corrugated cardboard is wrapped around the swing roll, a number of flute tips of the single faced corrugated cardboard that are to be concurrently in contact with the gluing roll and applied with the glue is adjusted by moving only the swing roll in such a direction that crosses a sheet face of the single faced corrugated cardboard passing through the nip, center axes of the gluing roll and the pressure roll are horizontally arranged, and the pressure roll is arranged on the same horizontal level as the gluing roll, so that a bend caused by the weight of the pressure roll is not generated on the nip between the gluing roll and pressure roll.

6. The device according to claim 5, wherein the gluing roll and the pressure roll are arranged such that an angle between a plane connecting the center axis of the gluing roll with the center axis of the pressure roll and a horizontal plane is within ±15 degrees.

7. The device according to claim 5, wherein:

the swing roll is arranged over/above the gluing roll and the pressure roll;

the single faced corrugated cardboard enters the nip between the gluing roll and the pressure roll from the upper end of the nip; and the single faced corrugated cardboard is wrapped around the pressure roll at an exit of the nip and is transferred in the lateral direction, so that a space under the nip is empty.

8. The device according to claim 6, wherein:

the swing roll is arranged over/above the gluing roll and the pressure roll;

the single faced corrugated cardboard enters the nip between the gluing roll and the pressure roll from the upper end of the nip; and the single faced corrugated cardboard is wrapped around the pressure roll at an exit of the nip and is transferred in the lateral direction, so that a space under the nip is empty.

9. The device according to claim 5, further comprising a controller that adjusts the number of flute tips of the single faced corrugated cardboard that are to be concurrently in contact with the gluing roll and applied with the glue by moving the swing roll in accordance with one of parameters of a basic weight, a flute shape, and a travelling speed.

10. The device according to claim 6, further comprising a controller that adjusts the number of flute tips of the single faced corrugated cardboard that are to be concurrently in contact with the gluing roll and applied with the glue by moving the swing roll in accordance with one of parameters of a basic weight, a flute shape, and a travelling speed.

11. The device according to claim 7, further comprising a controller that adjusts the number of flute tips of the single faced corrugated cardboard that are to be concurrently in contact with the gluing roll and applied with the glue by moving the swing roll in accordance with one of parameters of a basic weight, a flute shape, and a travelling speed.

12. The device according to claim 8, further comprising a controller that adjusts the number of flute tips of the single faced corrugated cardboard that are to be concurrently in contact with the gluing roll and applied with the glue by moving the swing roll in accordance with one of parameters of a basic weight, a flute shape, and a travelling speed.

13. A double facer comprising a gluing device defined in claim 5.

14. A double facer comprising a gluing device defined in claim 8.

15. A double facer comprising a gluing device defined in claim 12.

16. The method according to claim 1, wherein the swing roll is located above the gluing roll and the pressure roll, and is moved laterally in a direction close to or away from the pressure roll so that the number of the flute tips of the single faced corrugated cardboard contacting with the glue roll is changed to thereby adjust the number of flute tips of the single faced corrugated cardboard applied with the glue.

17. The method according to claim 1, wherein the single faced corrugated cardboard is guided toward the nip between the gluing roll and the pressure roll by a guide roll, and the swing roll is arranged between the nip and the guide roll, and moves toward the single faced corrugated cardboard to decrease an amount of glue applied to each flute tip, and moves away from the single faced corrugated cardboard to increase the amount of glue applied to each flute tip.

18. The method according to claim 5, further comprising:

a guide roll for guiding the single faced corrugated cardboard toward the nip between the gluing roll and the pressure roll, wherein the swing roll is arranged between the nip and the guide roll, and moves toward the single faced corrugated cardboard to decrease an amount of glue applied to each flute tip, and moves away from the single faced corrugated cardboard to increase the amount of glue applied to each flute tip.

* * * * *